US011879297B2

(12) United States Patent
Schicker

(10) Patent No.: US 11,879,297 B2
(45) Date of Patent: Jan. 23, 2024

(54) THREAD FORMATION FOR COUPLING DOWNHOLE TOOLS

(71) Applicant: REFLEX INSTRUMENTS ASIA PACIFIC PTY LTD, Balcatta (AU)

(72) Inventor: Owen Schicker, Balcatta (AU)

(73) Assignee: REFLEX INSTRUMENTS ASIA PACIFIC PTY LIMITED, Balcatta (AU)

( * ) Notice: Subject to any disclaimer, the term of this patent is extended or adjusted under 35 U.S.C. 154(b) by 29 days.

(21) Appl. No.: 17/637,757

(22) PCT Filed: Aug. 27, 2020

(86) PCT No.: PCT/AU2020/050897
§ 371 (c)(1),
(2) Date: Feb. 23, 2022

(87) PCT Pub. No.: WO2021/035301
PCT Pub. Date: Mar. 4, 2021

(65) Prior Publication Data

US 2022/0282580 A1 Sep. 8, 2022

(30) Foreign Application Priority Data

Aug. 30, 2019 (AU) ..... 2019903186

(51) Int. Cl.
*E21B 17/042* (2006.01)

(52) U.S. Cl.
CPC ..... *E21B 17/0423* (2013.01)

(58) Field of Classification Search
CPC ..... E21B 17/0423
See application file for complete search history.

(56) References Cited

U.S. PATENT DOCUMENTS 4,753,460 A 6/1988 Tung
6,155,613 A * 12/2000 Quadflieg ..... F16L 15/001 285/334
6,206,436 B1 3/2001 Mallis
(Continued)

FOREIGN PATENT DOCUMENTS

WO 2014/043505 A1 3/2014
WO WO-2019068145 A1 * 4/2019 ..... E21B 10/64

OTHER PUBLICATIONS

Australian Patent Office, International Search Report issued in corresponding Application No. PCT/AU2020/050897 dated Oct. 22, 2020.

(Continued)

*Primary Examiner* — D. Andrews
(74) *Attorney, Agent, or Firm* — Stites & Harbison, PLLC; Terry L. Wright

(57) ABSTRACT

The disclosure relates to a thread formation and to a downhole tool comprising a hollow tubular pipe section having an end on which the thread formation is provided. The thread formation comprises a first thread having a first thread start and a second thread having a second thread start, wherein the first thread start is operatively rotationally in advance of the second thread start. Accordingly, the first thread is configured to engage at least partially with a complementary thread formation on another downhole tool before the second thread engages with the complementary thread formation.

20 Claims, 10 Drawing Sheets

(56) References Cited

U.S. PATENT DOCUMENTS

| | | | | |
|---|---|---|---|---|
| 2010/0123311 | A1* | 5/2010 | Church | E21B 17/0426 403/334 |
| 2017/0074050 | A1 | 3/2017 | Grimmer et al. | |

OTHER PUBLICATIONS

Australian Patent Office, Written Opinion ssued in corresponding Application No. PCT/AU2020/050897 dated Oct. 22, 2020.

* cited by examiner

THREAD FORMATION FOR COUPLING DOWNHOLE TOOLS

TECHNICAL FIELD

The present disclosure relates to a thread formation for coupling downhole tools.

More particularly, the present disclosure relates to a thread formation for coupling downhole tools wherein the thread formation is a multi-start thread, e.g. a three-start thread.

BACKGROUND

In mineral drilling operations, such as when conducting core drilling, a borehole is drilled using a drill string made up of interconnected tubular drill rods with a drill bit provided at the downhole end of the drill string. It is known to provide retractable drill bit systems and/or retractable core barrels that can be lowered through the drill string to engage at the downhole end of the drill string. An example of such a system is shown in WO 2019/068145, wherein a drilling tool, comprising a core barrel, is able to be lowered and retrieved on a wireline within the drill string. The core barrel itself comprises an outer tube enclosing an inner tube, with the outer tube rotating and carrying the drill bit for drilling out the core and with the inner tube being non-rotating for receiving and holding the core so that the core can be retracted to the surface without being damaged.

The downhole tools and core barrels are typically of a cumbersome length, making them unwieldy to transport and store, and for this reason they are generally manufactured in sections that are coupled together by means of threads immediately prior to use.

When core drilling, it is preferable to extract a core sample having an as large as possible diameter because then more useable data can be obtained for geological analysis. The core sample diameter achievable is dependent on the types of drill rods used in the drilling operation, wherein the drill rods normally come in standardised sizes, e.g. B, N, H or HWT sizes, wherein for example B-size rods will yield a borehole having a diameter of about 60.0 mm and N-size rods will yield a borehole having a diameter of about 75.5 mm.

In normal wire line core drilling, the outer tubes are permanently mounted on the downhole end of the drill string, while the inner tubes are able to be withdrawn from the outer tubes through the drill string to extract the core sample. The core samples are received within the inner tubes which themselves need to fit within the drill rods to be withdrawn, thus the extracted core samples normally have a diameter of about 60-67% of the borehole diameter. Using N-size drill rods typically yields a core sample having a diameter of about 45-51 mm.

When core drilling with retractable drill bit systems, the core barrel (i.e. the combined outer and inner tubes) is withdrawn through the drill string when extracting the core sample that is received within the inner tube. Thus the outer and inner tubes have smaller diameters so that the core barrel can fit within the drill rods, thereby resulting in the extracted core samples normally having a reduced diameter of about 58-59% of the borehole diameter. Using N-size drill rods typically yields a core sample having a diameter of about 44 mm.

One way to maximise the core sample diameter in retractable drill bit systems for each of the various size drill rods is to make the annular walls of the core barrels as thin as possible, e.g. by decreasing the sidewall thickness of the outer tube and/or the inner tube from the standard thickness of about 5.5 mm to a reduced thickness of about 3 mm—resulting in about a 20% increase in the core sample diameter. One problem encountered with such thin-walled core barrels, particularly in those having multiple pipe sections threadedly joined to each other, is that the thread itself weakens the ends of the pipe sections. In use, when excessive drill torque is applied to the core barrel, the weakened threaded ends of the pipe sections can become damaged by outward flaring (see FIG. 1*a*) or belling (see FIG. 1*b*) thereof.

Furthermore, it is an inherent requirement of the type of retractable drilling system disclosed in WO 2019/068145 (and other equivalent systems) that the tool/barrel that is lowered through the drive sub and drill string is in a relatively snug fit. Any flaring or belling damage to the tool/barrel will increase its outer diameter and prevent the tool/barrel from sliding freely within/through the drive sub—in severe cases the tool/barrel can become wedged within the drill string or will not be able to be retracted through the drive sub as described in WO 2019/068145.

The flaring or belling problem can be alleviated by increasing the inherent strength within the threaded part of the pipe section by using multi-start threads to increase the lead angle. However, this can lead to further problems. If the respective threaded ends are incorrectly aligned when being attached the pipe sections may not engage properly and the threaded ends can become damaged and prevent subsequent proper threaded engagement. Incorrect coupling or alignment may also lead to small shavings of metal finding themselves between the threads, which causes galling. Excessive galling also damages the threads and in extreme cases can separate the tool into its individual parts. When this happens, the driller needs to stop the drilling operation and to recover the 'lost' pipe section of the tool from the drill hole.

The above references to the background art and any prior art citations do not constitute an admission that the art forms part of the common general knowledge of a person of ordinary skill in the art.

SUMMARY OF THE DISCLOSURE

According to a first aspect of the disclosure, there is provided a thread formation for coupling downhole tools, the thread formation being a multi-start thread and comprising

- a first thread having a first thread start;
- a second thread having a second thread start;
- wherein the first thread start is operatively rotationally in advance of the second thread start; and
- wherein the first thread is configured to engage at least partially with a complementary thread formation on another downhole tool before the second thread engages with the complementary thread formation.

The first thread start may be operatively rotationally in advance of the second thread start by at least 5°. In one embodiment the first thread start is rotationally operatively in advance of the second thread start by at least 25°.

The first thread start may be located in an axially tapered part of the first thread.

The thread formation may comprise a third thread having a third thread start, wherein the first thread start is operatively rotationally in advance of the third thread start. In one embodiment the second thread start is operatively rotationally co-aligned with the third thread start. In another embodiment the second thread start is operatively rotationally in advance of the third thread start.

According to a second aspect of the disclosure, there is provided a downhole tool comprising a hollow tubular pipe section having an end;

a thread formation provided on the end, wherein the thread formation further comprises a first thread having a first thread start;

a second thread having a second thread start;

wherein the first thread start is operatively rotationally in advance of the second thread start; and wherein the first thread is configured to at least partially engage with a complementary thread formation on another downhole tool before the second thread engages with the complementary thread formation.

The first thread start may be operatively rotationally in advance of the second thread start by at least 5° to 25°.

The first thread start may be located in an axially tapered part of the first thread.

The thread formation may comprise a third thread having a third thread start, wherein the first thread start is operatively rotationally in advance of the third thread start. In one embodiment the second thread start is operatively rotationally in co-aligned with the third thread start. In another embodiment the second thread start is operatively rotationally in advance of the third thread start.

In one embodiment the pipe section has an outer diameter and a side wall thickness, wherein the side wall thickness is <10% of the outer diameter and each of the threads has a maximum thread depth being about 25%-40% of the side wall thickness.

When the pipe section is configured to fit within an N-size drill rod, the side wall thickness may be <3 mm. In such case each of the threads may have a maximum thread depth<1 mm.

The pipe section may comprise a core tool or a part thereof, a core barrel outer tube, a core barrel inner tube or a coring rod.

The downhole tool may further comprise a plurality of coupling members provided on the downhole tool, the coupling members being able to extend or retract in a radial direction relative to the downhole tool to respectively permit coupling or decoupling of the downhole tool to a drive sub mounted on a drill string, and wherein the downhole tool is configured to at least partially extend axially through the drive sub.

The downhole tool may comprise two or more pipe sections that are joined together at discrete coupling interfaces by using the thread formation whereby, during use, at least one of the coupling interfaces is configured to pass through the drive sub and be located axially beyond a downhole end of the drive sub.

BRIEF DESCRIPTION OF DRAWINGS

The above and other features will become more apparent from the following description with reference to the accompanying schematic drawings. In the drawings, which are given for purpose of illustration only and are not intended to be in any way limiting.

DETAILED DESCRIPTION

Figure 1A:
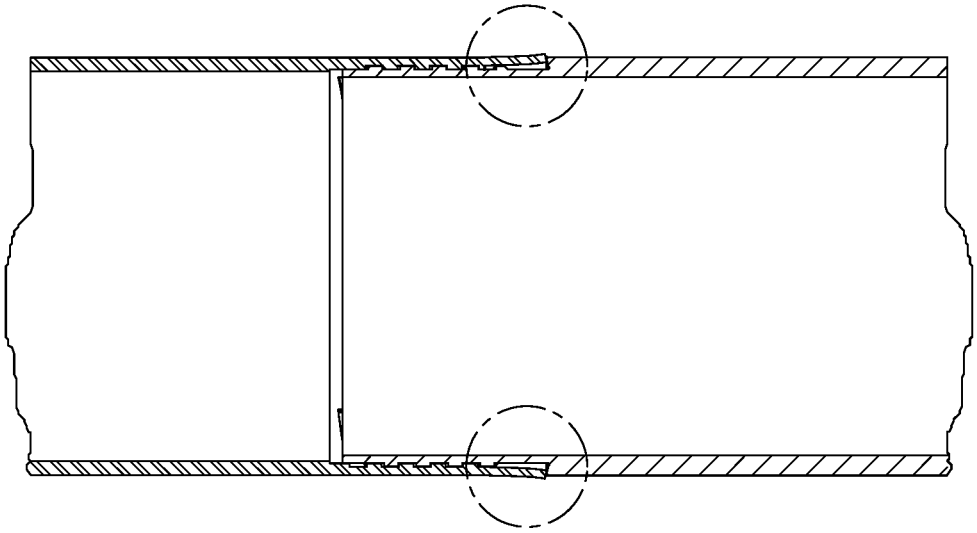
FIGS. 1A and 1B are sectional side views showing the types of damage that may potentially be suffered in pipe sections having conventional thread formations.
Figure 1B:
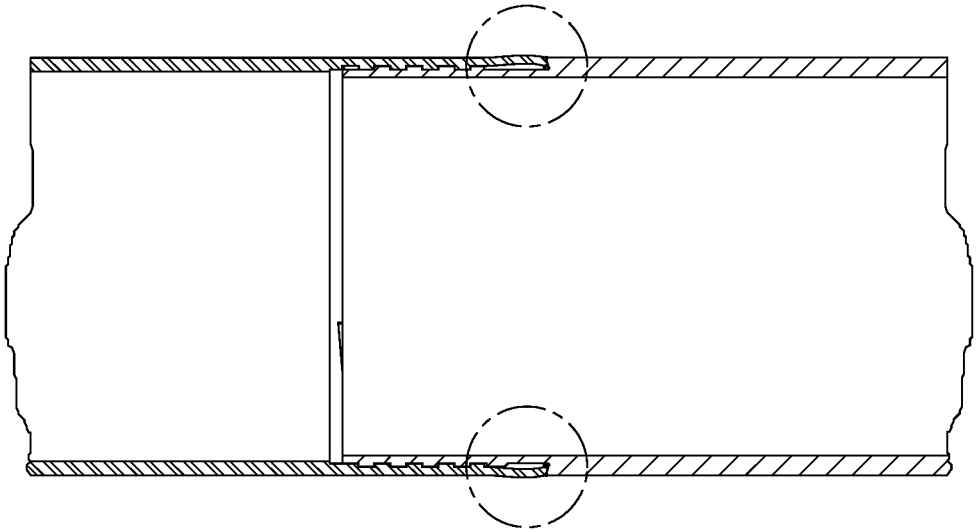
Figure 2:
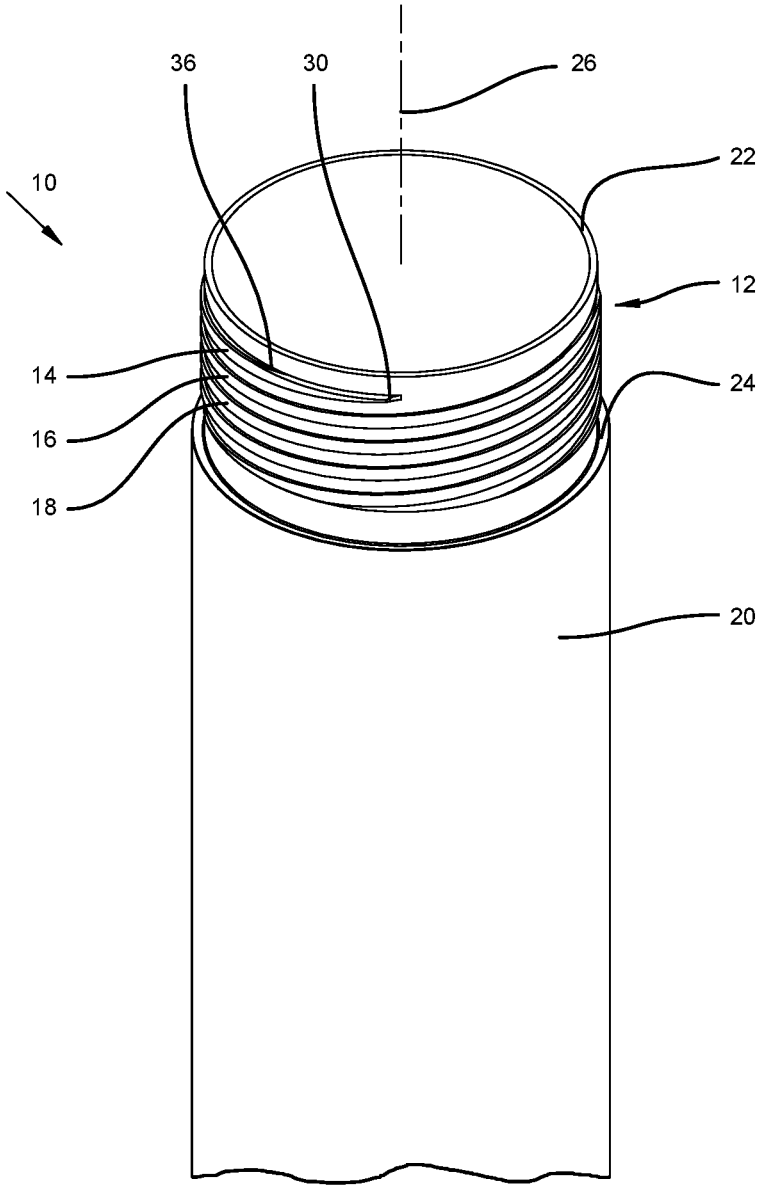
FIG. 2 is a perspective view of a pipe section of a downhole tool that is provided with a thread formation for coupling with other downhole tools.

FIGS. 2 to 10 show a pipe section 10 provided with a thread formation 12 for coupling downhole tools. The pipe section 10 shown is representative only and it should be understood that the thread formation 12 can be provided on any requisite or suitable downhole tool or part thereof. Accordingly, the pipe section 10 can be part of a core barrel, e.g. an outer or an inner core tube, any other coring tools or rods, or a delivery tool for the downhole delivering of coring tools or core barrels. The thread formation 12 can be provided on one end only of the pipe section 10 or on both ends thereof. Also, the thread formation 12 can be provided as a male or female thread being configured to engage with a complementary threaded male or female thread on another tool or pipe section.

The thread formation 12 is a multiple start thread, also referred to as a multi-start thread, comprising two or more intertwined threads running parallel to each other and thereby allowing the lead distance of the thread to be increased without changing its pitch. A double or two-start thread will have a lead being double that of a single start thread of the same pitch, whereas a triple or three-start thread will have a lead being three times longer than a single start thread of the same pitch, and so on. The exemplary embodiment of the thread formation 12 shows a three-start thread having a first thread 14, a second thread 16 and a third thread 18.

The pipe section 10 has a substantially tubular body 20 having an outer axial face 22 at one end thereof. The thread formation 12 leads from the face 22 and terminates short of an annular shoulder 24 projecting outwardly from the body 20. As is known in the art, the thread formation 12 may be slightly spaced away from the face 22 so that a thread guide is defined between the face 22 and the thread formation 12. In some embodiments the shoulder 24 projects radially outwardly, i.e. perpendicularly from a longitudinal axis 26 of the pipe section 10. As can be more clearly seen in FIG. 4, the exemplary embodiment of the shoulder 24 is angled towards the axial face 22 so that the shoulder 24 forms a slight concave recess 28 facing towards the thread formation 12.

Figure 4:
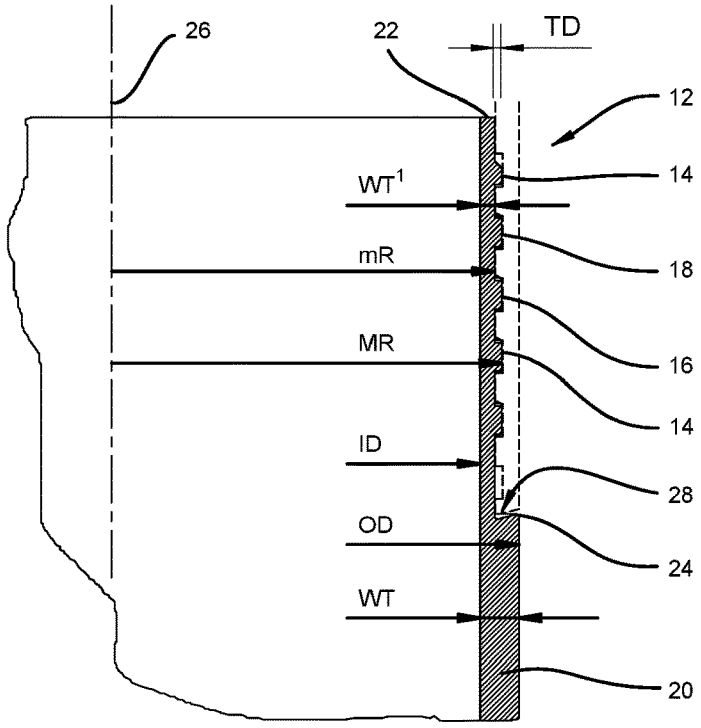
FIG. 4 is a sectional front side view through the thread formation seen along arrows IV-IV in FIG. 3 and showing a complementary female pipe section in dashed outline.

The threads 14,16,18 of the exemplary embodiment are square profile threads having square or rectangular cross-section as can be more clearly seen in FIG. 4. It is known in the art to use square profile threads in high load applications.

In other embodiments the threads 14,16,18 can have a modified square profile, such as being trapezoidal having a 0-5 degree flank angle, or have an acme profile. Yet further, the threads 14,16,18 can have any other cross-section profile known in the art.

The pipe section 10 is configured to fit as required within a drill string. In the exemplary embodiment the pipe section 10 is configured to fit within an N size dill rod. For this reason the body 20 is dimensioned to have an outer diameter OD of about 55 mm. In order to maximise a tubular cavity defined within the pipe section 10 and thereby maximise a core sample diameter that can be received therein, the body 20 is made with a relatively thin side wall so as to maximise its internal diameter ID. A thin side walled pipe section 10 is considered as one wherein the body 20 has a side wall thickness WT being <7% of the body's outer diameter OD. In the exemplary embodiment, the body 20 has an inner diameter ID of about 49-50 mm, which results in the side wall thickness WT being about 2.5-3 mm. It will therefore be understood that the body 20 has a side wall thickness WT being <10% of its outer diameter OD, and generally being about 5-6% of its outer diameter OD.

In order to join two complementary threaded pipe sections 10,10.1 (see FIG. 11) the thread pitch will need to lie intermediate the side wall thickness WT. Accordingly, the thread formation 12 has a minor radius mR of about 25-26 mm and a major radius MR of about 26-27 mm, which results in the threads 14,16,18 having a maximum thread depth TD of about 1 mm. It will therefore be understood that the thread depth is about 25%-40% of the side wall thickness WT. Furthermore, due to machining the thread formation 12 into the body 20, the side wall thickness $WT^1$ extending along the thread formation 12 is only about 1 mm.

In the exemplary embodiment the pipe section 10 has the following dimensions:

outer diameter OD=55.3 mm (outer radius≈27.6 mm)
inner diameter ID=50 mm (inner radius=25 mm)
wall thickness WT=2.6 mm
thread major radius MR≈26.5 mm
thread minor radius mR=26 mm
thread depth TD≈0.5 mm
wall thickness $WT^1$=1 mm.

It will be appreciated that in alternative embodiments the pipe section 10 may be configured to fit within other sized dill rods, that may be commonly known as B, H, P or HWT sizes, each of which have different side wall thicknesses. Accordingly, the maximum thread depth that can be obtained in each size will vary slightly.

In the complementary female pipe section 10.1 that is to threadingly engage with the male pipe section 10, the dimensions of its thread depth and its side wall thickness extending along the thread formation will be largely similar to those described above. It will therefore be appreciated by the skilled addressee that the above dimensions define very tight tolerances and that the threaded ends of the respective pipe sections may be structurally weak and susceptible to damage during use when drilling torque is applied to the pipe sections 10,10.1 (i.e. to the outer tube of the core barrel).

Each thread 14,16,18 has a thread start 30,32,34 respectively at or near the axial face 22. As is common in the art, the threads 14,16,18 terminate on a plane orthogonal to the axis 26 thereby causing the threads 14,16,18 to taper towards the plane so that they have a reduced thread width leading into the thread starts 30,32,34. If these tapers fully traverse the threads 14,16,18, each thread will taper from a taper start point 36 and terminate at a taper end point 38 (see FIG. 3), with each of the start points 36 and each of the end points 38 respectively being equally circumferentially spaced apart substantially by 120°. However, such tapered threads will result in very sharp, fine and structurally weak thread starts 30,32,34. To avoid this occurring, the thread starts 30,32,34 are cut short to define blunt starts (commonly known as a Higbee start) as can be seen in FIGS. 2 to 10, e.g. by cutting away a part of the threads.

According to the present disclosure, the thread start 30 of the first thread 14 is unique and differently formed compared to the thread starts 32,34 of the second and third threads 16,18. This is to allow the first thread 14 to facilitate alignment and engagement of the second and third threads 16,18 into their counterpart threads when the pipe section 10 threadedly engages a complementary threaded pipe section as will be described in due course. In other embodiments wherein the thread formation 12 comprises a different number of threads, e.g. a two-start or a four-start thread, the first thread 14 will be unique while the remaining threads can each be similar to or different to each other provided that none of these other threads are similar to the first thread.

Figure 3:
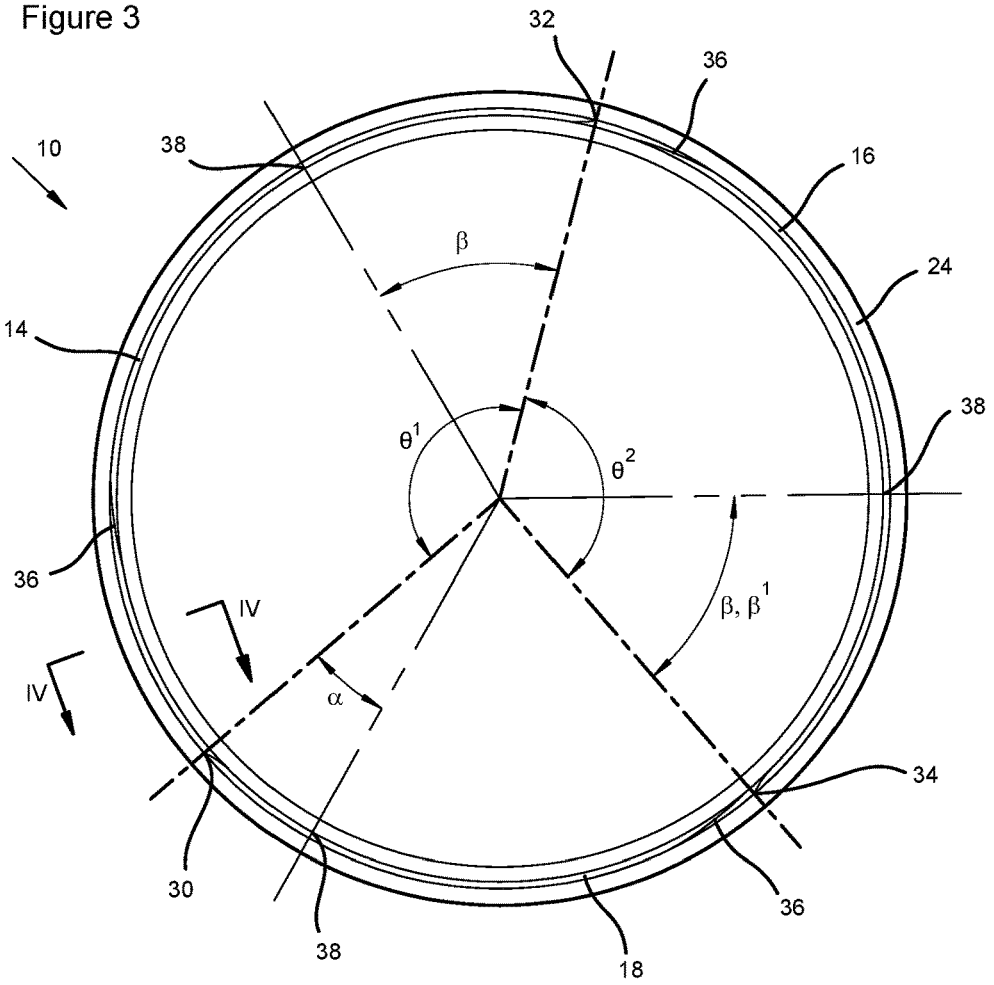
FIG. 3 is a top end view of the pipe section shown in FIG. 2.
Figure 5:
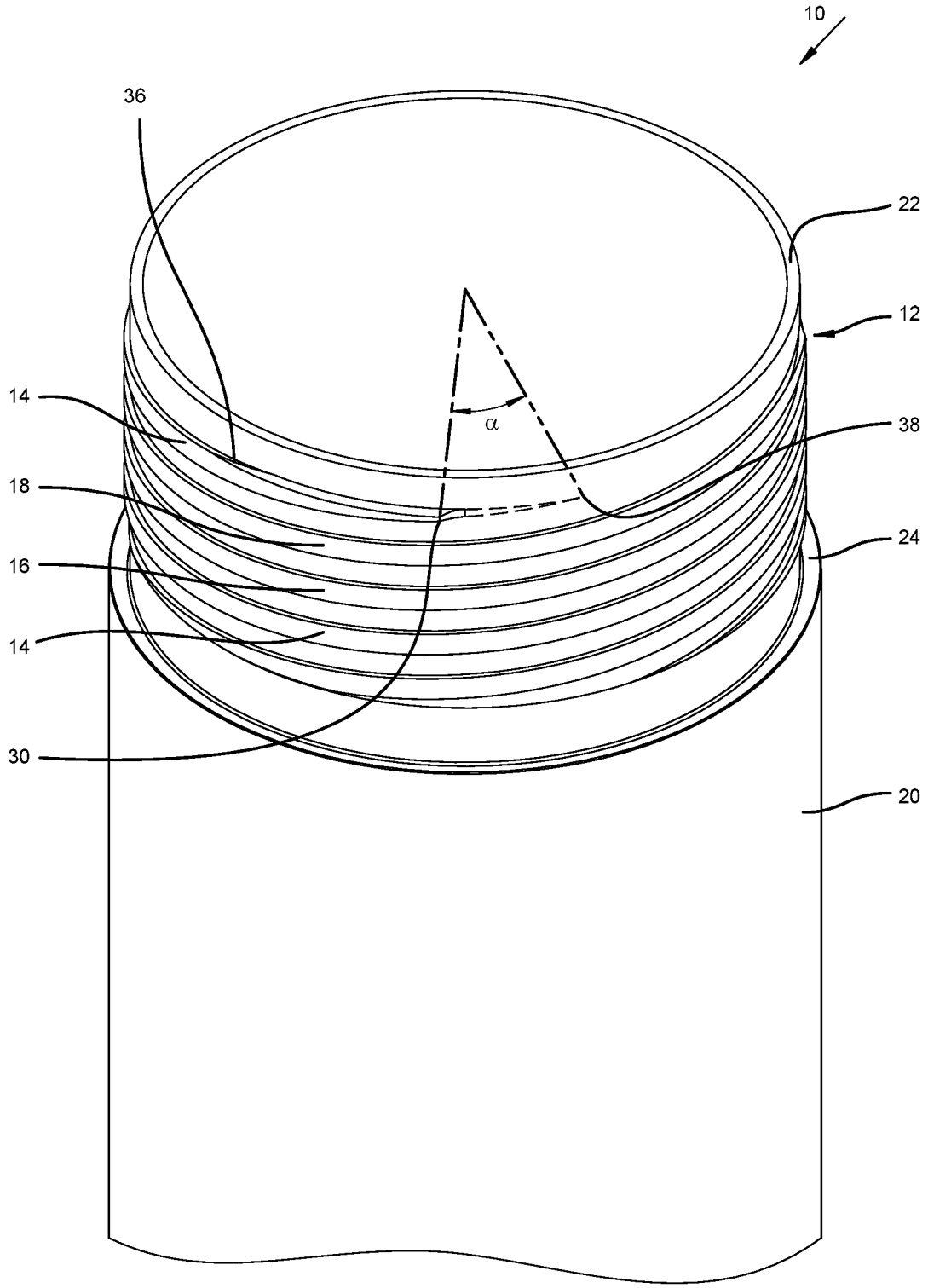
FIG. 5 is an enlarged perspective view of a top part of the pipe section of FIG. 2 seen from one quadrant.
Figure 6:
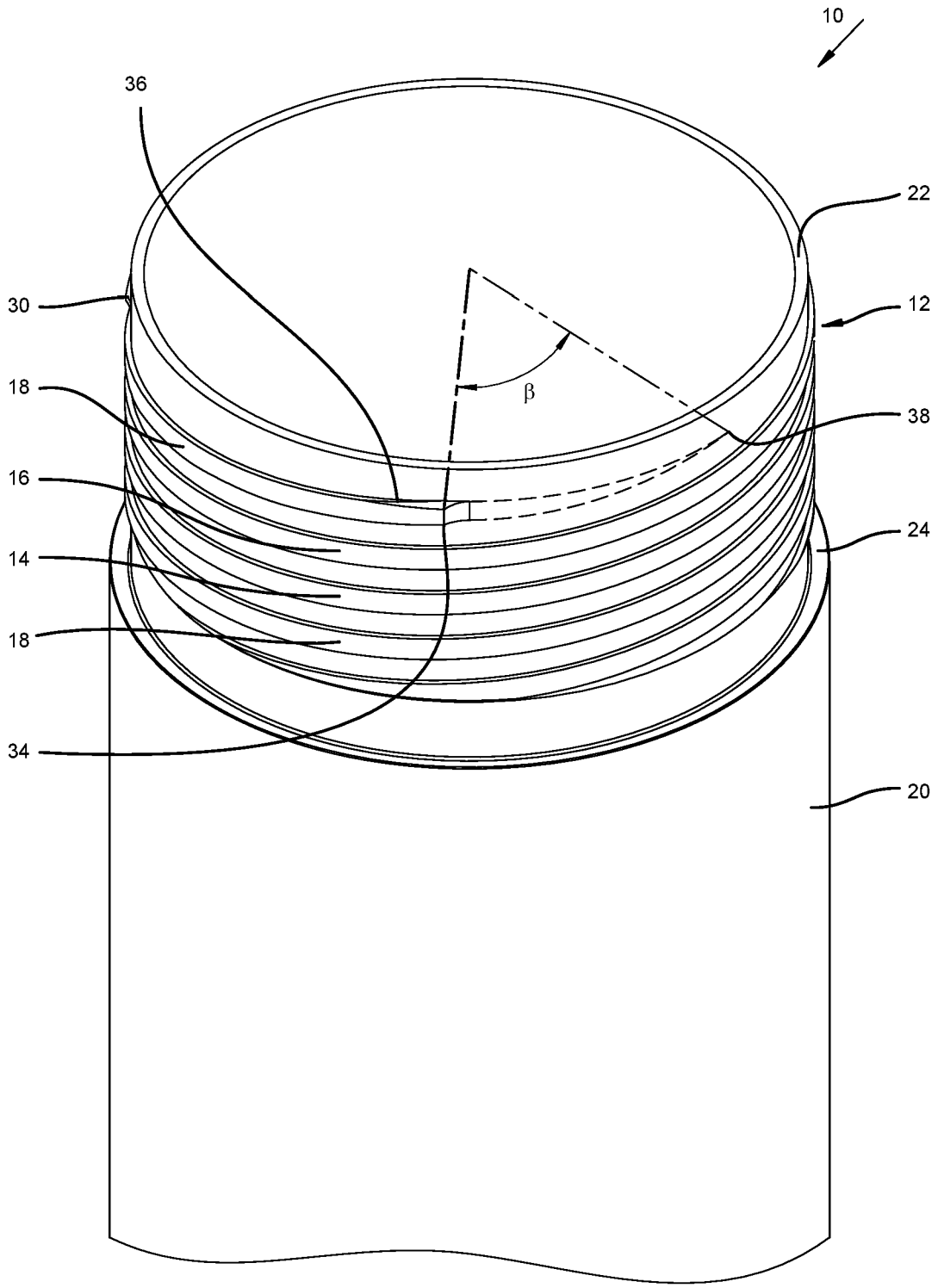
FIG. 6 is an enlarged perspective view of a top part of the pipe section of FIG. 2 seen from a different quadrant.
Figure 7:
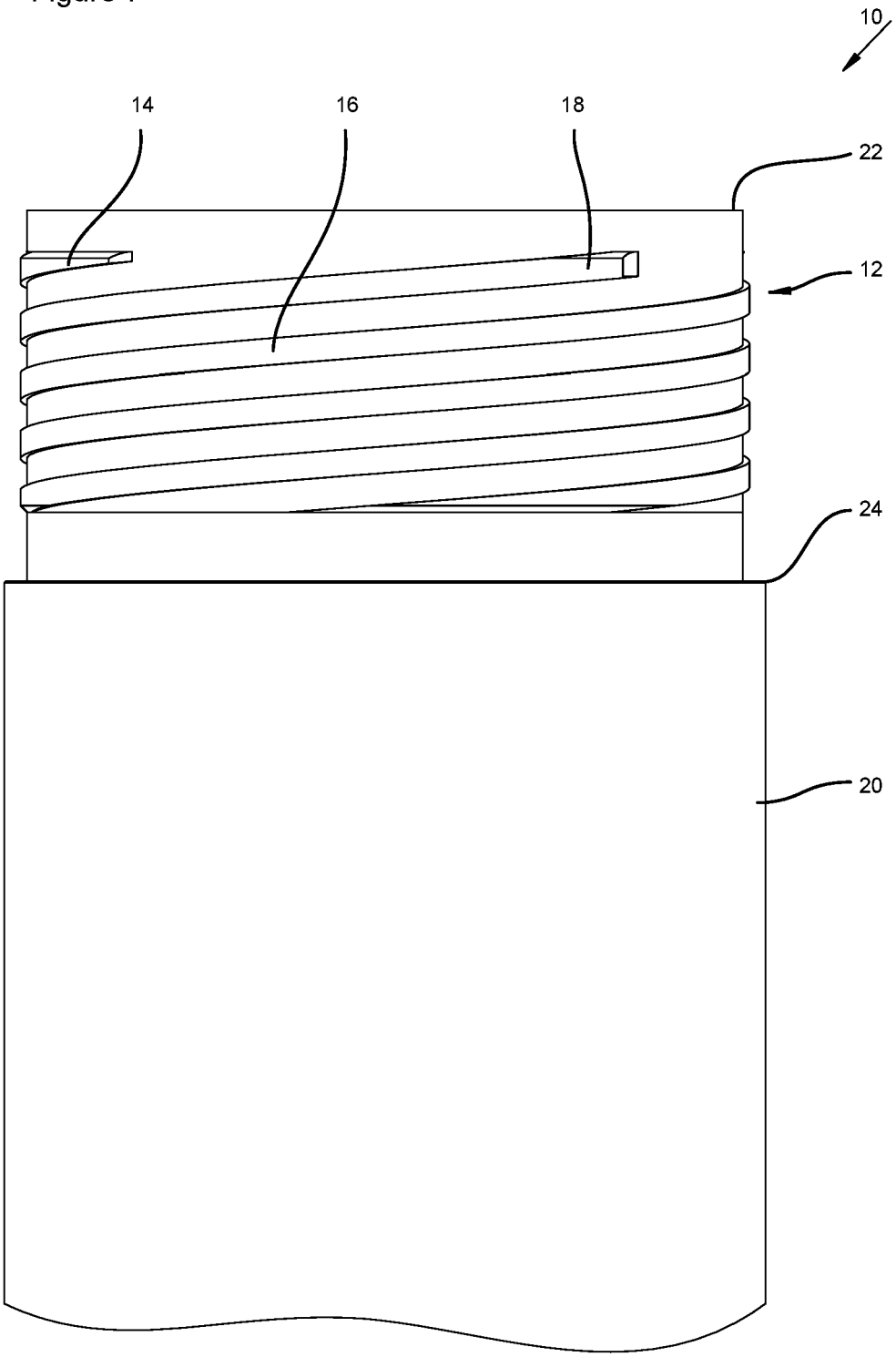
FIG. 7 is a front side view of the top part of the pipe section shown in FIG. 5.
Figure 8:
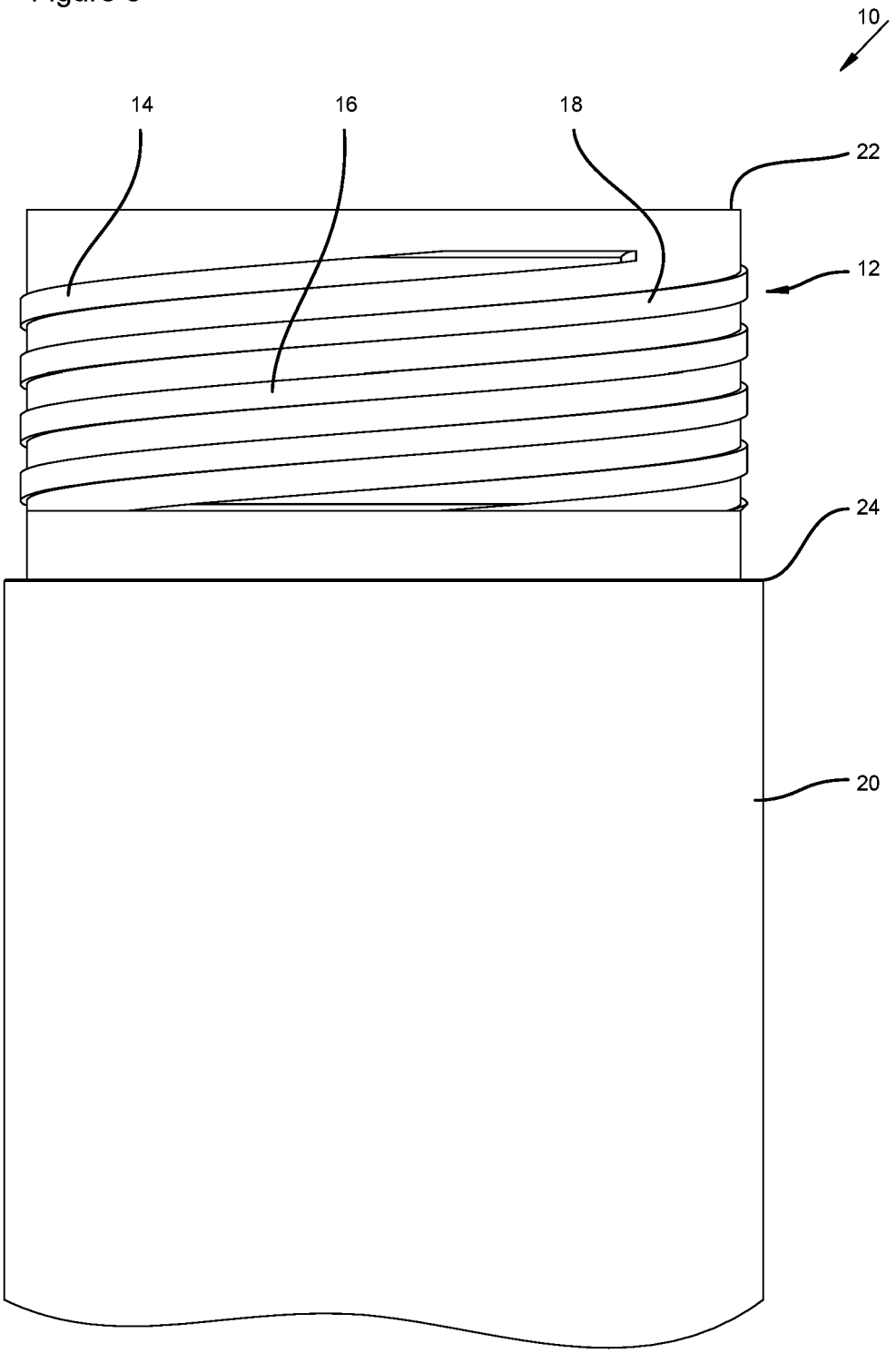
FIG. 8 is a left side view of the top part of the pipe section shown in FIG. 5.
Figure 9:
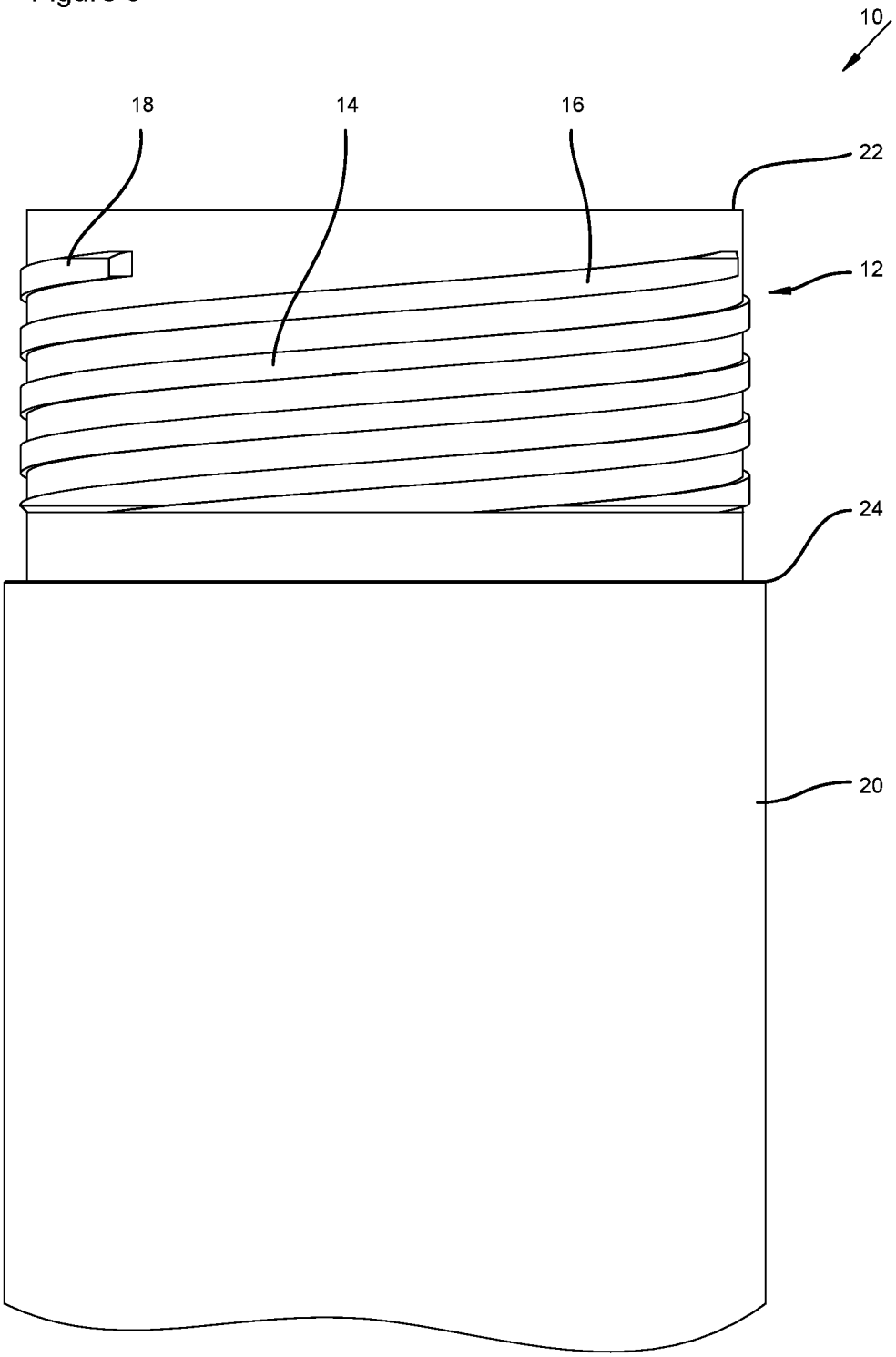
FIG. 9 is a right side view of the top part of the pipe section shown in FIG. 5.
Figure 10:
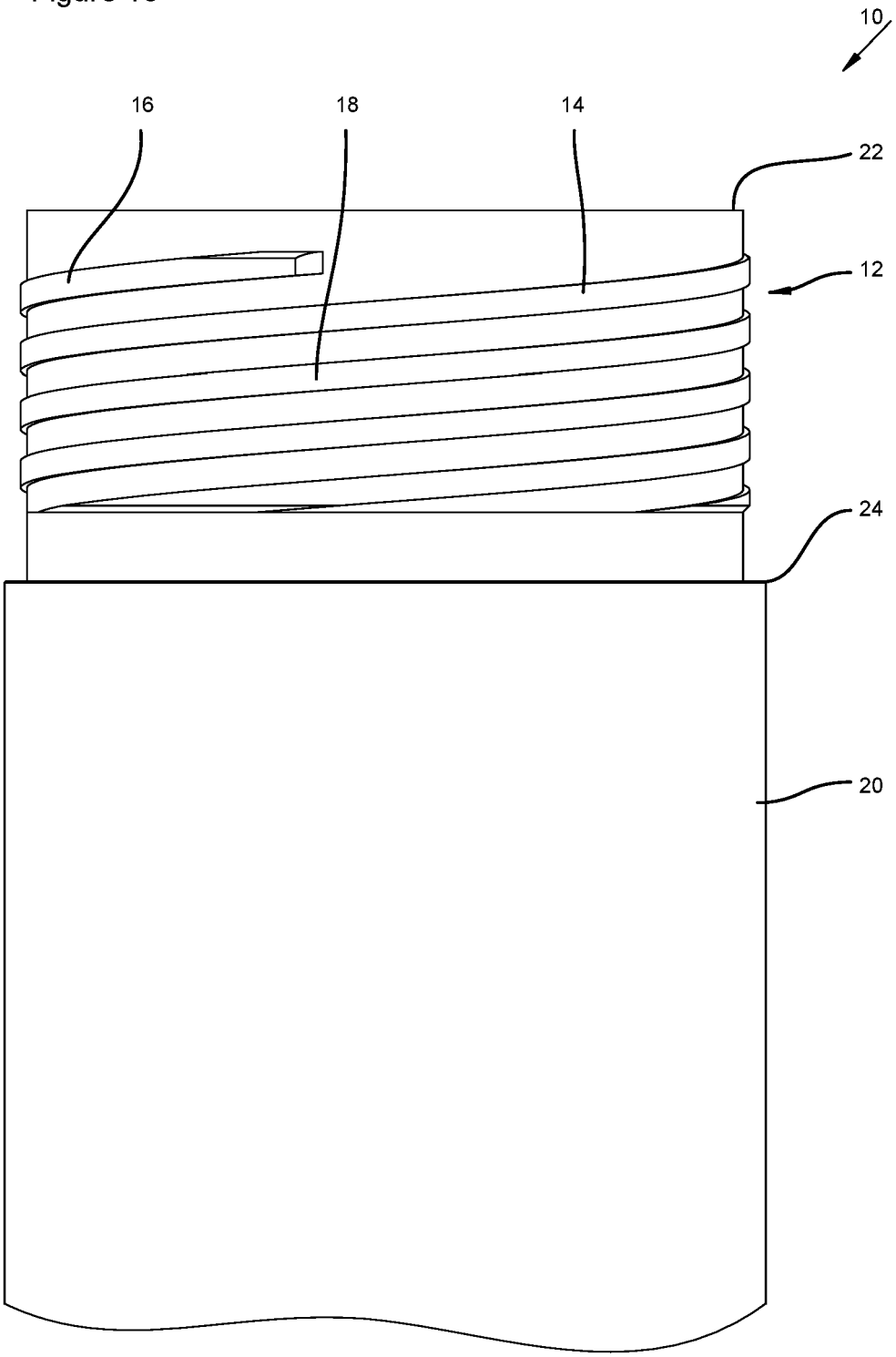
FIG. 10 is a back side view of the top part of the pipe section shown in FIG. 5.

In the current example, the first thread 14 has its thread start 30 cut short by a circumferential angle $\alpha$ being between 5° to 30° (see FIGS. 3 and 5). The size of angle $\alpha$ will depend on the thread pitch and slope angle of the thread formation 12. However, angle $\alpha$ should be less than the circumferential angle through which the taper of first thread 14 extends so that the thread start 30 is circumferentially located between the first thread's taper start point 36 and its taper end point 38. In the exemplary embodiment the angle $\alpha$ is about 20°.

In a similar manner, the second thread 16 and third thread 18 both have their respective thread starts 32,34 cut short by a similar circumferential angle $\beta$ being between 20° to 60° (see FIGS. 3 and 6), with angle $\beta$ being larger than angle $\alpha$. Angle $\beta$ can be greater than the circumferential angles through which the tapers of the second and third thread 16,18 extend so that the thread starts 32,34 are circumferentially located beyond the taper start points 36 of the second and third threads 16,18. In the exemplary embodiment the angle $\beta$ is about 45°.

As shown in FIG. 3, in the exemplary embodiment thread start 32 of second thread 16 is circumferentially spaced by an angle $\theta^1$ of about 145° from the thread start 30 of first thread 14, while thread start 34 of third thread 18 is circumferentially spaced by an angle $\theta^2$ of about 120° from the thread start 32 of second thread 16.

The respective threads 14,16,18 and their thread starts 30,32,34 can be more clearly seen in FIGS. 7 to 10.

In use, when the pipe section 10 threadedly engages a complementary threaded pipe section, the first thread 14 will engage first and will remain the only engaged thread while the pipe sections are axially rotated relative to each other through an angle of $\beta$-$\alpha$, i.e. in the exemplary embodiment for rotation through an angle of about 25°. The tapered part of first thread 14 causes its thread start 30 to have a smaller cross-sectional thread width than the complementary groove into which it is to enter—this provides additional axial clearance when engagement commences and allows the first thread 14 to smoothly engage within its complementary thread. The first thread 14 will be substantially if not fully engaged before the second and third threads 16,18 start engaging so that there is restricted axial movement possible between the pipe section 10 and the complementary pipe section. There will also be restricted lateral movement or axial bending possible between the pipe section 10 and the complementary pipe section. This ensures that the second and third threads 16,18 are aligned and can cleanly engage into their complementary threads with further rotational coupling and thereby avoiding galling and damage to the thread formation 12.

It will be appreciated that the above described embodiment, wherein the threads 14,16,18 are cut short to a thread depth of 0 mm, is configured to engage with a complementary pipe section having a standard thread formation, e.g. with all its threads being similar and having all its thread starts equally circumferentially spaced. However, in other embodiments where the complementary pipe section has a non-standard thread formation, it is envisaged that the second and third threads 16,18 may be cut short to have a thread depth of between 1% to 99% of their final thread depth, provided that the second and third threads of the complementary pipe section are respectively similarly cut short to have a corresponding thread depth of between 99% to 1% so that the respective second and third threads are not able to engage with each other until after the first threads engage and the pipe sections are axially rotated relative to each other through an angle of $\beta$-$\alpha$.

In some embodiments the third thread 18 may have its thread start 34 cut back further to an angle $\beta^1$ (see FIG. 3), with angle $\beta^1$ being greater than angle $\beta$. In use this will result in the first thread 14 engaging first and remaining the only engaged thread while the pipe sections are axially rotated relative to each other through an angle of $\beta$-$\alpha$. Thereafter the second thread 16 will engage while the pipe sections are axially further rotated relative to each other through an angle of $\beta^1$-$\beta$. Finally, the third thread 18 will engage after the pipe sections are axially further rotated through more than angle $\beta^1$.

It will be appreciated that it may be the second thread 16 that has its thread start 32 cut back to the angle $\beta^1$, which will result in the order of thread engagement being first thread 14, third thread 18 and finally second thread 16.

When used in a core drilling operation, the multi-start thread formation 12 on the pipe section 10 is configured to alleviate the axial force applied under the drill torque by the complementary pipe section acting on the shoulder 24 of pipe section 10.

When such pipe sections 10 are joined using a conventional single start thread the lead angle (axial thread slope) is shallow, the drilling torque causes a large axial load to be applied onto the shoulder 24 with relatively little of the drilling torque being dissipated through the thread connection. Conventional thick-walled pipe sections can handle this axial load on the shoulder without belling of the pipe section ends. However, when thin-walled pipe sections 10 are used, the axial load exceeds the handling strength and the threaded ends of the pipe sections then become damaged by flaring or belling.

By using the multi-start thread formation 12 in the pipe section 10 the lead angle (axial thread slope) becomes steeper, e.g. in a two-start thread the lead angle is twice that of a single start thread and in a three-start thread the lead angle is triple that of a single start thread. Increasing the lead angle allows a larger portion of the drilling torque to be dissipated through the thread connection and consequently alleviates the axial load that is applied onto the shoulder 24. Reducing the axial load on the shoulder 24 accordingly alleviates flaring or belling damage to the threaded ends of the pipe sections.

Figure 11:
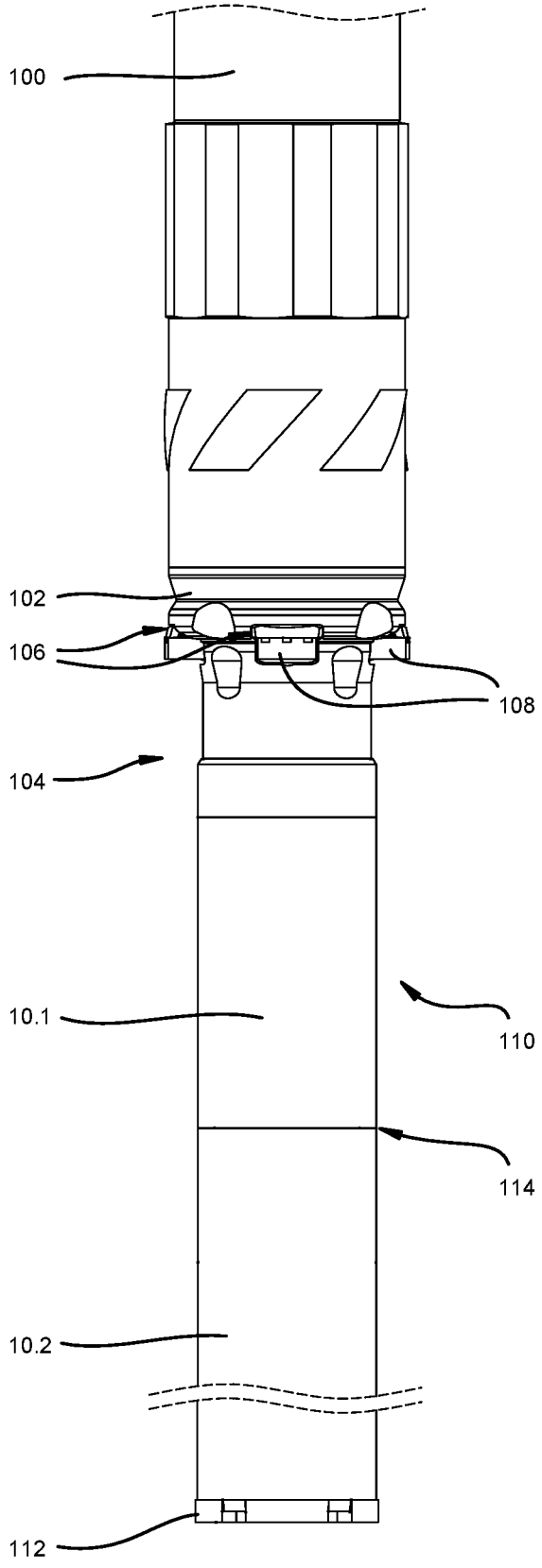
FIG. 11 is a side view of the downhole end of a drill string provided with a drive sub engaging a downhole tool utilising the thread formation.

In one example, the thread formation 12 can be provided on a downhole tool to be used in the retractable drill bit system as described in WO 2019/068145. FIG. 11 shows a bottom portion of a drill string 100 having a drive sub 102 joined to its downhole end. A downhole tool 104 extends through the drive sub 102 and is releasably attached thereto so that torque imparted to the drill string 100 is transferred by the drive sub 102 to the downhole tool 104.

It will be appreciated by those skilled in the art that the downhole tool 104 can comprise several different parts arranged to perform different drilling functions. These parts are provided as respective subs that can be threadingly joined to each other end-on-end. Apart from the description below, for the purposes of this disclosure the individual tool parts and their working need not be described in detail.

The drive sub 102 has a castellated downhole edge in which there are provided a plurality of equally spaced slots 106. A number of coupling members 108 are provided along the length of the downhole tool 104, which coupling members 108 are able to extend or retract in a radial direction relative to the downhole tool 104. The coupling members 108 are able to be housed fully within the downhole tool 104 to permit travel thereof through the drill string 100 and drive sub 102. As shown in FIG. 11, when the downhole tool 104 engages the drive sub 102, the coupling members 108 are moved to project radially outwardly from the downhole tool 104 to engage into the slots 106 and couple the downhole tool 104 to the drive sub 102. Conversely, the coupling members 108 are able to be again retracted from the slots 106 and housed fully within the downhole tool 104 to decouple it from the drive sub 102 when withdrawing the downhole tool 104 through the drill string 100 and drive sub 102. The downhole tool 104 typically carries a core barrel assembly 110 having a drill bit 112 at its terminal downhole end.

In accordance with the present disclosure, the downhole tool 104 and/or core barrel assembly 110 comprises a first pipe section 10.1 that is joined to a second pipe section 10.2 at a coupling interface 114. The thread formation 12 is utilised to join the pipe sections 10.1 and 10.2 when the coupling interface 114 is configured to pass through the drive sub 102 during use and be located axially beyond a downhole end of the drive sub 102.

It will be appreciated by persons skilled in the art that numerous variations and/or modifications may be made to the thread formation as shown in the specific embodiments without departing from the spirit or scope of the disclosure as broadly described. The present embodiments are, therefore, to be considered in all respects as illustrative and not restrictive.

In the claims which follow and in the preceding description, except where the context requires otherwise due to express language or necessary implication, the word "comprise" or variations such as "comprises" or "comprising" is used in a non-limiting and an inclusive sense, i.e. to specify the presence of the stated features but not to preclude the presence or addition of further features in the various embodiments. A reference to an element by the indefinite article "a" does not exclude the possibility that more than one of the elements is present, unless the context clearly requires that there be one and only one of the elements.

REFERENCE NUMERALS

10 pipe section
10.1 pipe section
12 thread formation
14 first thread
16 second thread
18 third thread
20 body

22 face
24 shoulder
26 axis
28 recess
30 thread start
32 thread start
34 thread start
36 taper start point
38 taper end point
100 drill string
102 drive sub
104 downhole tool
106 slots
108 coupling members
110 core barrel assembly
112 drill bit
114 coupling interface
OD outer diameter
ID inner diameter
WT, $WT^1$ wall thickness
mR minor radius
MR major radius
TD thread depth
$\alpha$ angle
$\beta$, $\beta^1$ angle
$\theta^1$, $\theta^2$ angle

The invention claimed is:

1. A thread formation for coupling downhole tools, the thread formation being a multi-start thread and comprising
a first thread having a first thread start located in an axially tapered part of the first thread, the axially-tapered part of the first thread cut short by a circumferential angle $\alpha$;
a second thread having a second thread start located in an axially tapered part of the second thread, the axially-tapered part of the second thread cut short by a circumferential angle $\beta$;
wherein the first thread start is operatively rotationally in advance of the second thread start;
wherein the circumferential angle $\beta$ is greater than the circumferential angle $\alpha$; and
wherein the first thread is configured to at least partially engage with a complementary thread formation on a complementary downhole tool before the second thread engages within the complementary thread formation.

2. A thread formation as claimed in claim 1, wherein the first thread start is operatively rotationally in advance of the second thread start by an angle equal to 360° divided by a number of thread starts included in the thread formation.

3. A thread formation as claimed in claim 1, wherein the circumferential angle $\beta$ is greater than the circumferential angle $\alpha$ by at least 25°.

4. A thread formation as claimed in claim 1, wherein the first circumferential angle $\alpha$ is between 5° and 30°.

5. A thread formation as claimed in claim 1, further comprising a third thread having a third thread start, wherein the first thread start is operatively rotationally in advance of the third thread start.

6. A thread formation as claimed in claim 5,
wherein the third thread start is located in an axially tapered part of the third thread, the axially-tapered part of the third thread cut short by a circumferential angle $\beta_1$, and
wherein the axially tapered part of the second thread cut short by the circumferential angle $\beta$ is axially co-aligned with the circumferential angle $\beta_1$ of the third thread, the circumferential angle $\beta_1$ being equal to the circumferential angle $\beta$.

7. A thread formation as claimed in claim 5, wherein the second thread start is operatively rotationally in advance of the third thread start.

8. A downhole tool comprising
a hollow tubular pipe section having an end;
a thread formation provided on the end, wherein the thread formation further comprises
a first thread having a first thread start located in an axially tapered part of the first thread, the axially-tapered part of the first thread cut short by a circumferential angle $\alpha$;
a second thread having a second thread start located in an axially tapered part of the second thread, the axially-tapered part of the second thread cut short by a circumferential angle $\beta$;
wherein the first thread start is operatively rotationally in advance of the second thread start;
wherein the circumferential angle $\beta$ is greater than the circumferential angle $\alpha$; and
wherein the first thread is configured to at least partially engage within a complementary thread formation on a complementary downhole tool before the second thread engages within the complementary thread formation.

9. A downhole tool as claimed in claim 8, wherein the first thread start is operatively rotationally in advance of the second thread start by an angle equal to 360° divided by a number of thread starts included in the thread formation.

10. A downhole tool as claimed in claim 8, wherein the circumferential angle $\alpha$ is between 5° and 30°.

11. A downhole tool as claimed in claim 8, further comprising a third thread having a third thread start, wherein the first thread start is operatively rotationally in advance of the third thread start.

12. A downhole tool as claimed in claim 11, wherein the third thread start is located in an axially tapered part of the third thread, the axially-tapered part of the third thread cut short by a circumferential angle $\beta_1$, and
wherein the second thread start is operatively rotationally in co aligned with the third thread start the axially tapered part of the second thread cut short by the circumferential angle $\beta$ is axially-co-aligned with the circumferential angle $\beta_1$ of the third thread, the circumferential angle $\beta_1$ being equal to the circumferential angle $\beta$.

13. A downhole tool as claimed in claim 11, wherein the second thread start is operatively rotationally in advance of the third thread start.

14. A downhole tool as claimed in claim 8, wherein the pipe section has an outer diameter and a side wall thickness, and the side wall thickness is <10% of the outer diameter.

15. A downhole tool as claimed in claim 14, wherein each of the threads has a maximum thread depth being 25%-40% of the side wall thickness.

16. A downhole tool as claimed in claim 14, wherein the pipe section is configured to fit within an N-size drill rod and the side wall thickness is <3 mm.

17. A downhole tool as claimed in claim 16, wherein the each of the threads has a maximum thread depth<1 mm.

18. A downhole tool as claimed in claim 8, which comprises a core tool or a part thereof, an outer core barrel, an inner core barrel or a coring rod.

19. A downhole tool as claimed in claim 8, further comprising a plurality of coupling members provided on the downhole tool, the coupling members being able to extend or retract in a radial direction relative to the downhole tool to respectively permit coupling or decoupling of the downhole tool to a drive sub mounted on a drill string, and wherein the downhole tool is configured to at least partially extend axially through the drive sub.

20. A downhole tool as claimed in claim 19, wherein the downhole tool comprises two or more pipe sections that are joined together at discrete coupling interfaces by using the thread formation whereby, during use, at least one of the coupling interfaces is configured to pass through the drive sub and be located axially beyond a downhole end of the drive sub.

* * * * *